United States Patent [19]

Yoho

[11] 4,352,349

[45] Oct. 5, 1982

[54] CONTROL CIRCUIT FOR AIR CONDITIONING SYSTEMS

[76] Inventor: Robert W. Yoho, 10606 49th St., North, St. Petersburg, Fla. 33520

[21] Appl. No.: 94,103

[22] Filed: Nov. 14, 1979

[51] Int. Cl.[3] ..... F24C 15/20

[52] U.S. Cl. ..... 126/299 R; 237/46; 236/49; 236/DIG. 9; 98/32; 165/11 R

[58] Field of Search ..... 126/41, 110, 299 D; 98/115 LH, 32; 431/20; 237/19, 46; 55/DIG. 36; 236/49; 165/11

[56] References Cited

U.S. PATENT DOCUMENTS

| | | | |
|---|---|---|---|
| 2,182,106 | 12/1939 | Ames | 126/299 R |
| 3,650,262 | 3/1972 | Root et al. | 431/20 |
| 4,121,199 | 10/1978 | Young | 126/299 D |

FOREIGN PATENT DOCUMENTS

| | | | |
|---|---|---|---|
| 2308973 | 11/1976 | France | 126/299 |

*Primary Examiner*—Albert J. Makay
*Assistant Examiner*—Henry Bennett
*Attorney, Agent, or Firm*—Frijouf, Rust & Pyle

[57] ABSTRACT

A control system is disclosed for use in a restaurant having a forced air input air conditioning and/or heating system and a grill with an exhaust fan operating therewith. The invention includes an exhaust fan sensor means for monitoring the operative condition of the exhaust fan. A grill control means is provided for controlling the on/off operation of the grill. An air input sensor means senses the operative condition and the air flow of the air conditioning and/or heating system. A controller is connected for monitoring the sensors and for inhibiting operation of the grill upon an inoperative condition of the exhaust fan. The controller further inhibits operation of the air conditioning and/or heating system upon an inoperative condition of the exhaust fan thereby insuring the correct temperature within the restaurant. The invention may optionally include a stand-by power supply, a line voltage monitor and programmable thermostatic controller. An optional automatic telephone dialer may be connected to the controller for providing communication to a remote location of the inoperative condition of the system. The foregoing is merely a resume of one general application, is not a complete discussion of all principles of operation and applications and is not to be construed as a limitation on the scope of the claimed subject matter.

10 Claims, 3 Drawing Figures

CONTROL CIRCUIT FOR AIR CONDITIONING SYSTEMS

BACKGROUND OF THE INVENTION

1. Field of the Invention

This invention relates to ventilation air conditioning and heating and more particularly to a system for controlling the air conditioning and ventilation of a restaurant.

2. Description of the Prior Art

The increased price of fossilized fuel coupled with the advances in solid state technology have produced unprecedented advancements in the control of temperature systems for heating and air conditioning systems. The low cost of solid state circuitry promises substantial energy savings through the use of programmable thermostatic controllers.

The use of programmable temperature controllers is especially important in commercial or public buildings which are now required under Federal Law to have a minimum air conditioning thermostatic temperature and a maximum heating thermostatic temperature. Unfortunately, the programming of a temperature controller in a restaurant is a more difficult and complex matter than the temperature control in other commercial or public office buildings. A restaurant requires exhaust vents for the grills to exhaust unwanted smoke and the like from the remainder of the enclosure. Unfortunately, the prior art has not produced a control system which is suitable for use with a restaurant and which provides a programmable temperature control system specifically adapted for a restaurant installation.

Therefore, in order to overcome the inherent and particular inadequacies of the prior art, it is a primary object of this invention to provide a control system for restaurant ventilators.

Another object of this invention is to provide a control system for a forced air inut unit operating within an enclosure having a grill including an exhaust fan sensor and a grill control means with an interlock therebetween for inhibiting operation of the grill upon an inoperative condition of the exhaust fan.

Another object of this invention is to provide a control system for a forced air input unit operating within an enclosure having a grill including an air conditioning and/or heating sensor connected by a controller to the exhaust fan sensor for inhibiting operation of the forced air input unit upon an inoperative condition of the exhaust fan.

Another object of this invention is to provide a control system for a forced air input unit operating within an enclosure having a grill including a line input sensor for terminating operation of the grill upon sensing a reduction of input voltage below a preselected minimum value.

Another object of this invention is to provide a control system for a forced air input unit operating within an enclosure having a grill incorporating a battery operated stand-by power unit for operating the control system in the event of failure of the line voltage.

Another object of this invention is to provide a control system for a forced air input unit operating within an enclosure having a drill including a telephone dialer for providing communication to a remote location of an inoperative condition of an essential component of the system.

Another object of this invention is to provide a control system for a forced air input unit operating within an enclosure having a grill which provides a plurality of thermostatic temperatures which may be preselected in accordance with a preestablished program of time and desired temperature.

The foregoing has outlined some of the more pertinent objects of the invention. These objects should be construed to be merely illustrative of some of the more prominent features and applications of the intended invention. Many other beneficial results can be attained by applying the disclosed invention in a different manner or modifying the invention within the scope of the disclosure. Accordingly, other objects and a fuller understanding of the invention may be had by referring to the summary of the invention and the detailed description describing the preferred embodiment in addition to the scope of the invention defined by the claims taken in conjunction with the accompanying drawings.

SUMMARY OF THE INVENTION

The subject invention relates to an air conditioning and/or ventilation system for a restaurant. The invention is incorporated into a control system for a forced air input unit operating within an enclosure having a grill and an exhaust fan. The invention comprises an exhaust fan sensor means for sensing the operative state of the exhaust fan. Grill control means is provided for controlling the on/off operation of the grill. An air input sensor means senses the operating state of the forced air input unit. A controller means is connected to the sensors for inhibiting operation of the grill upon an inoperative state of the exhaust fan. The controller also inhibits operation of the forced air input unit upon an inoperative state of the exhaust fan.

In a more specific embodiment of the invention, the exhaust fan sensor means comprises means for sensing the electrical input to the fan motor powering the exhaust fan. In the alternative or supplementing the aforementioned, the exhaust fan sensor means comprises a temperature sensor disposed in an exhaust duct between the grill and the exhaust fan for sensing the temperature rise in the exhaust duct upon an inoperative condition of the exhaust fan. The grill control means may comprise an electrically operated gas valve interposed between a gas source and the gas burner of the grill for controlling the on/off operation of the burner. In the alternative, the grill control means may comprise a controllable switch for controlling electrical power to the electrical heating elements of the grill.

The forced air input unit preferably includes an air conditioning system. In this embodiment, the air input sensor means comprises means for sensing the electrical input to an input fan motor of the forced air input unit. The air input sensor means may also include a pressure differential switch disposed across an air filter located within the air flow path of the forced air input unit. Accordingly, excessive pressure buildup across the air filter indicates a dirty filter for triggering a warning indicator prior to the termination of operation.

The invention may optionally comprise an auxiliary stand-by power supply to power the controller during failure of normal power to the system. An input power sensor means may be connected to the controller for terminating operation of the grill upon sensing a reduction of input voltage below a preselected minimum value. An optional telephone dialing device may be connected to the controller for providing communication to a remote source of the inoperative condition of the system. The invention also includes a thermostat control means selectable between at least two preset temperatures in accordance with a preselected temperature cycle program. Preferably, this program is selectable by a time sequence from a clock internal the temperature control means.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION

Figure 1:
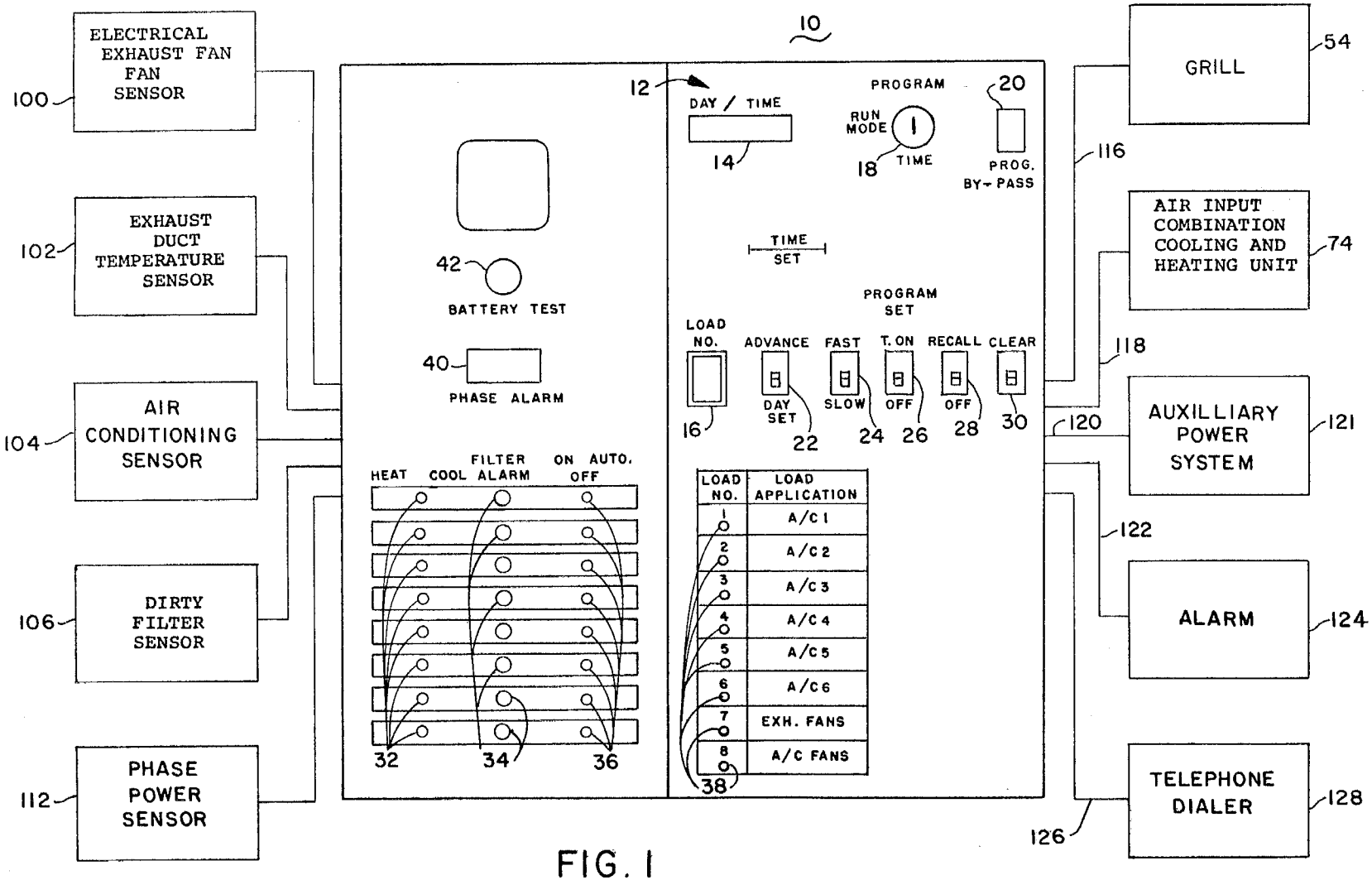
FIG. 1 is a block diagram of a control system for use in a restaurant having an input air conditioning and/or heating system and a grill with a exhaust fan.
Figure 2:
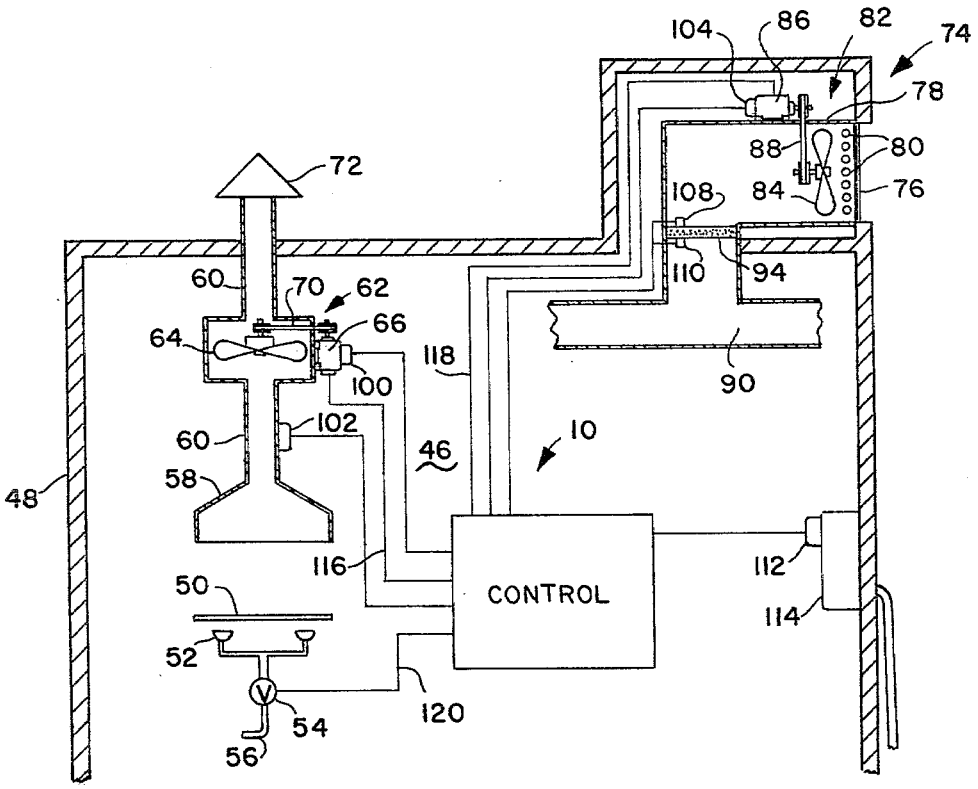
FIG. 2 is a schematic diagram of the system of FIG. 1 in a closed environment simulating a restaurant building.

FIG. 1 illustrates a block diagram of a novel control system installed within a restaurant as shown schematically in FIG. 2. The control system shown generally as 10 comprises a programmable controller 12 for controlling the temperature in a plurality of zones within a building structure. In this embodiment, the programmable controller 12 is established for controlling the temperature in eight separate zones indicated as load number 1-8. The programmable controller 12 includes a digital indicator 14 for indicating date and time in addition to a digital indicator 16 for indicating load number being programmed. A master key switch 18 controls the function between a programming mode, a run mode and a time set for setting the correct time into the controller 12. A program bypass switch 20 overrides the program within the programmable controller for manual operation.

Programming of the programmable controller 12 is accomplished through the use of input switches 22-30. Switch 22 is used for programming dates whereas switches 24 and 26 program time. Switch 28 recalls the program recorded within the memory of programmable controller 12. A clear switch 30 enables subsequent or reprogramming of the device. The heat or cooling condition of the programmable controller is indicated by lights 32 for each of the load numbers 1-8. A fliter alarm indicator 34 is likewise disposed for each of the load numbers 1-8. The condition of operation of the program for each of the load numbers is also indicated by indicators 36 for each of the load numbers 1-8. Input switch 38 provides programming input for each of load numbers 1-8.

The controller also includes a phase alarm 40 which indicates a loss of one of the phases of a three-phase system with a battery test indicator 42 established for testing an auxiliary power supply. It should be appreciated by those skilled in the art that the instant programmable controller enables the operator to control the time and temperature for each of eight zones to be cycled in accordance with a time produced by a clock (not shown) internal the programmable controller 12. Accordingly, the overnight temperature of a restaurant may utilize a high air conditioning temperature or a low temperature with the temperature gradually or sequentially adjusted prior to opening of the restaurant. The proper temperature in accordance with the federal reguations is achieved at the time of opening of the restaurant. Such a step cycling of the air conditioning unit saves substantial costs of cooling or heating by eliminating overcorrection of temperature normally encounted in the conventional system.

The programmable controller 12 finds application in various types of building structures including commercial, office buildings, homes, factories, and the like. This programmable controller may be utilized in a restaurant but, as previously mentioned, it is not specifically designed for restaurant operation. Accordingly, the present invention incorporates the programmable controller 12 within a general control system shown in FIGS. 1 and 2 to accomplish many desirable features specifically encountered in a restaurant or the like.

Referring more specifically to FIG. 2, an enclosure generally indicated as 46 enclosed by walls 48 is schematically representative of a restaurant structure. The restaurant comprises a grill 50 having gas burners 52 with an electrically operated valve 54 interposed in a gas pipe 56 from a gas supply (not shown). A grill vent 58 comprises a flue 60 with a grill exhaust fan 62 including an exhaust blade 64 powered by an exhaust motor 66 through a belt 70. The flue 60 extends through the ceiling of the restaurant to a conventional roof or vent 72.

An air input unit, shown generally as 74, comprises a screen air input 76 extending into an input duct 78 with heating and/or cooling coils 80 disposed therein. An input fan 82 comprising a blade 84 driven by a fan motor 86 through a belt 88 forces the input air into the enclosure 46 through conventional distribution ducts 90 as symbolically shown in FIG. 2. A filter 94 is disposed in the input duct 78 to ensure proper filtration of the input air into the enclosure 46. The input unit 74 may be representative of a heating and/or cooling system. It should also be understood that the heating and/or cooling system may be a separate and distinct system and it should be understood that the control device hereinafter set forth is equally applicable to either combined or separate air conditioning or heating systems. It should also be appreciated that the grill 50 has been disclosed as a gas grill but the burners 52 may be interchanged for electrically operated heating elements with valve 54 being replaced by a conventional switching device.

The control system 10 incorporates an exhaust fan sensor 100 for sensing the operative condition of the exhaust fan 62. More specifically, the exhaust fan sensor 100 may comprise a current sensor to fan motor 66. An exhaust duct sensor 102 is a temperature responsive sensor disposed to measure the temperature in flue 60 from the grill vent 58. This second exhaust duct sensor will sense any increase in heat in the exhaust duct 60 in the event the fan belt 70 severs, making blade 64 inoperable while motor 66 will continue to draw current. Accordingly, sensor 100 will be unable to detect inoperation of blade 64. An air conditioning sensor 104 senses the operative condition of the air input unit 74. More specifically, this air conditioning sensor 104 comprises means for measuring the current input to motor 86 of the input fan 82. A further sensor 106 comprises differential pressure sensors 108 and 110 to sense the pressure differential across the air conditioning filter 94. In addition, the differential switches 108 and 110 sense the positive pressure produced by fan blade 84 in the event that the fan belt 88 servers in which case the blade will be non-functional yet sensor 104 will sense current flow to the motor 86. A phase power sensor 112 senses the power through the input line box 114 as shown in FIG. 2.

The input sensors shown in FIGS. 1 and 2 control the programmable controller 12 to energize or deactivate various components of the system shown in FIG. 2. The control is connected to the grill and more specifically to the valve or switch 54 by a connector 116 to terminate operation of the grill in the event the exhaust fan sensor 100 or the exhaust duct sensor 102 detects a lack of operation of the fan blade 64. Similarly, the controller maintains the operation of the air conditioner or air inputs 74 through a connector 118. In the event that the sensors detect an unfavorable condition, the controller 12 will terminate operation of the air input unit 74. The controller 10 is connected by a line 120 to a standby auxiliary power system 121. In addition, a line 122 connects the controller to an alarm 124 in addition to a line 126 connecting the controller to an automatic telephone dialer 128.

Figure 3:
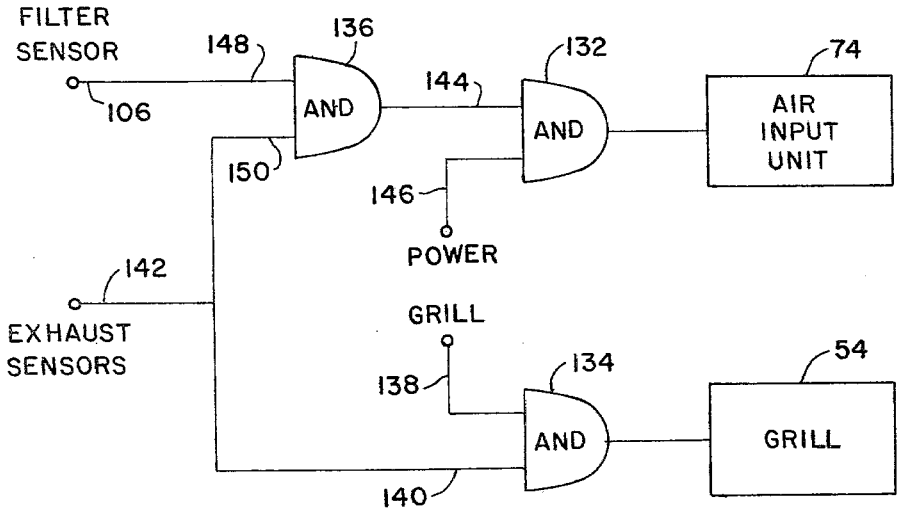
FIG. 3 is a schematic diagram of the primary interlock of the control system shown in FIGS. 1 and 2.

The interlock between the various sensors and the components is illustrated more specifically in FIG. 3. In this diagram, the logic is set forth in terms of AND gates which produce an output only upon an input to both of the input terminals. The air input unit 74 and the grill 54 are respectively energized by 132 and 134. And gate 136 also drives one of the inputs to AND gate 132. Input 138 is connected for sensing the grill power namely either electricity or gas with the other input 140 connected to the exhaust sensor terminal 142 which may comprise both exhaust fan sensor 100 and exhaust duct sensor 102. Accordingly, for the grill 54 to be energized grill power must be applied to terminal 138 as well as a favorable signal from the exhaust fan and exhaust duct sensor. In a similar manner, the air input unit receives signals from AND gate 132 having inputs 144 and 146. Input 146 monitors the available power to the air input unit whereas input 144 receives an output from AND gate 136. The inputs 148 and 150 of AND gate 136 receives a signal from the filter sensor 106 as well as the exhaust sensor 142. Accordingly, in order for the input air unit to operate, the filter sensor must indicate a satisfactory filter and the exhaust sensor 142 must indicate the exhaust fan 62 in operation as well as sufficient power indicated on line 146. In the event of failure of power, failure of a clean filter or failure of the exhaust fan 62, the logic circuit will terminate operation of the air input unit. Similarly, failure of grill power or failure of the exhaust fan will terminate operation of the grill 54.

The alarm 124 may be a visual or audible alarm which may alert personnel on the premises. An optional telephone dialer 128 may be incorporated into the unit for communicating with the remote location to show the inoperability of a system component. It should be appreciated by those skilled in the art that many numerous variations such as the incorporation of fire and burgular equipment may similarly be incorporated within the invention as set forth herein.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described, what is claimed is:

1. A control system for controlling the operation of a forced air input cooling and heating unit including an input fan which forces outside air into a building and for controlling the operation of a grill and an exhaust unit including an exhaust duct and an exhaust fan which vents vapors from the grill to the outside of the building, comprising in combination:

an exhaust fan sensor for sensing the electrical input to the exhaust fan;

a first temperature sensor disposed within the exhaust duct for sensing the temperature in the exhaust duct;

grill control means for controlling the operating state of the grill;

an interlock means connected to said exhaust fan sensor and said first temperature sensor and said grill control means for inhibiting the operation of the grill and the exhaust fan when said exhaust fan sensor senses the absence of electrical input to the exhaust fan or when said temperature sensor senses a temperature rise in the exhaust duct above a normal operating temperature upon inoperation of the exhaust fan.

2. A control system as set forth in claim 1, wherein said grill control means comprises an electrically operated gas valve interposed between a gas source and a gas burner of the grill for controlling gas flow to the burner.

3. A control system as set forth in claim 1, wherein said grill control means comprises a controllable switch for controlling electrical power to electrical heating elements of the grill.

4. A control system as set forth in claim 1, including an auxiliary stand-by power supply for supplying power to the control system upon failure of normal power to the system.

5. A control system as set forth in claim 1, including an input power sensor means connected to said interlock means enabling said interlock means to inhibit the operation of the grill when said input power sensor means senses a reduction of input voltage below a preselected minimum value.

6. A controller as set forth in claim 1, including a telephone dialing device connected to the control system for providing communication to a remote source of the inoperative condition of the system.

7. The control system as set forth in claim 1, wherein the forced air input cooling and heating unit includes a filter for filtering the outside air upon being forced into the building, the control system further comprising in combination:

a first pressure sensor means located between the filter and the input fan for sensing the decrease in pressure indicative of a failure of a clean filter;

an alarm; and said interlock means connected to said first pressure sensor means for activating said alarm when said first pressure sensor detects a decrease in pressure.

8. The control system as set forth in claim 1, further comprising in combination:

an input fan sensor for sensing the operation of the input fan; and said interlock means connected to said input fan sensor for inhibiting the operation of the exhaust fan when the input fan is inoperable.

9. The control system as set forth in claim 1, further comprising in combination:

a second temperature sensor located within the building for sensing space temperature; and control means for controlling the operation of the forced air input combination cooling and heating unit in accordance with preselected temperature levels.

10. The control system as set forth in claim 9, wherein said control means includes an internal clock which enables the control means to control the operation of the forced air input combination cooling and heating unit in accordance with preselected time periods.

* * * * *

UNITED STATES PATENT AND TRADEMARK OFFICE

CERTIFICATE OF CORRECTION

PATENT NO. : 4,352,349
DATED : October 5, 1982
INVENTOR(S) : Robert W. Yoho

It is certified that error appears in the above-identified patent and that said Letters Patent are hereby corrected as shown below:

| | | |
|---|---|---|
| Col. 1, | line 40 | "inut" should be --input-- |
| | line 65 | "drill" should be --grill-- |
| Col. 3, | line 55 | after "set" insert --mode-- |
| | line 67 | "fliter" should be --filter-- |
| Col. 4, | line 17 | before "temperature" (1st occasion) insert --heating-- |

Signed and Sealed this

*Twenty-eighth* Day of *December 1982*

[SEAL]

*Attest:*

GERALD J. MOSSINGHOFF

*Attesting Officer*

*Commissioner of Patents and Trademarks*